United States Patent [19]

Berecz

[11] Patent Number: 4,569,628

[45] Date of Patent: Feb. 11, 1986

[54] TRANSFER MECHANISM

[75] Inventor: Imre Berecz, El Toro, Calif.

[73] Assignee: Microdot Inc., Darien, Conn.

[21] Appl. No.: 565,233

[22] Filed: Dec. 27, 1983

[51] Int. Cl.[4] ..... B66C 1/00

[52] U.S. Cl. ..... 414/739; 414/729

[58] Field of Search ..... 414/729, 739, 738

[56] References Cited

U.S. PATENT DOCUMENTS

| | | | |
|---|---|---|---|
| 3,645,408 | 2/1972 | Bronzini | 414/739 |
| 4,361,413 | 11/1982 | Toda | 414/752 |
| 4,455,044 | 6/1984 | Musits | 414/729 |

*Primary Examiner*—William E. Wayner

*Attorney, Agent, or Firm*—Lyman R. Lyon

[57] ABSTRACT

A transfer mechanism in which the jaws for gripping and transferring the workpiece are mounted for rotation with a pivot shaft so that the jaws are translated between spaced work stations as the pivot shaft is rotated, and a cam member rotates with the pivot shaft and also slides axially along the pivot shaft for camming coaction with the jaws to selectively open and close the jaws in any angular position of the pivot shaft and in any translatory position of the jaws.

12 Claims, 6 Drawing Figures

TRANSFER MECHANISM

BACKGROUND OF THE INVENTION

This invention relates to transfer mechanisms and more particularly to a mechanism for transferring blanks between dies for successive work operations.

Transfer mechanisms of this general description are well known and take many and varied forms. In general, they include a pair of jaws or grippers and a reciprocating mass for transporting the jaws between work stations. While the known transfer mechanisms of this type are generally satisfactory, the reciprocating mass of the transfer mechanism tends to be rather large, thereby limiting the speed of the mechanism, and independent adjustment of the specific gripping action of the jaws and of the precise translatory movement of the reciprocating mass tends to be rather difficult.

SUMMARY OF THE INVENTION

The present invention provides a transfer mechanism in which the reciprocating mass is exceptionally light, thereby allowing a very high mechanism speed, and in which independent adjustment of the gripping action of the jaws and of the translatory movement of the reciprocating mass is readily and accurately accomplished.

In the invention transfer mechanism, the jaws form part of a jaw assembly mounted for rotary movement with a pivot shaft and a cam assembly is carried by the pivot shaft for rotation with that shaft. The cam assembly is also movable axially along the pivot shaft for camming coaction with the jaw assembly to selectively open and close the jaws. This arrangement allows jaw actuation in any angular position of the pivot shaft and facilitates independent adjustment of the translatory movement of the jaws and of the opening and closing movement of the jaws.

According to an important feature of the invention, the jaw assembly comprises a scissors mechanism including a first pair of levers pivoted on the pivot shaft and a second pair of levers pivoted at their one ends to the one ends of the first pair of levers and pivotally mounted intermediate their ends on a common pivot pin. The free ends of the second pair of levers are configured to define the jaws of the transfer mechanism and the cam assembly is positioned for camming insertion between the first pair of levers, adjacent the pivot shaft, to selectively spread and close that pair of levers and selectively open and close the jaws.

According to a further feature of the invention, a guide slot is provided in one end of a rocker arm rigidly secured to the pivot shaft and the common pivot pin for the second pair of levers includes a guide pin portion positioned in the rocker arm slot so that, as the first pair of levers is selectively spread and closed by the camming insertion of the cam assembly, the guide pin portion slides in the rocker arm slot to guide and constrain the action of the jaw assembly and insure that the jaw assembly rotates with the rocker arm.

According to yet another feature of the invention, the cam assembly includes two slide members connected at their one ends and positioned in diametrically opposed, axial slideways in the pivot shaft, and the free end of one of the slide members is positioned and configured to define a cam wedge for camming insertion between the first pair of levers of the jaw assembly.

DETAILED DESCRIPTION OF THE PREFERRED EMBODIMENT OF THE INVENTION

Figure 1:
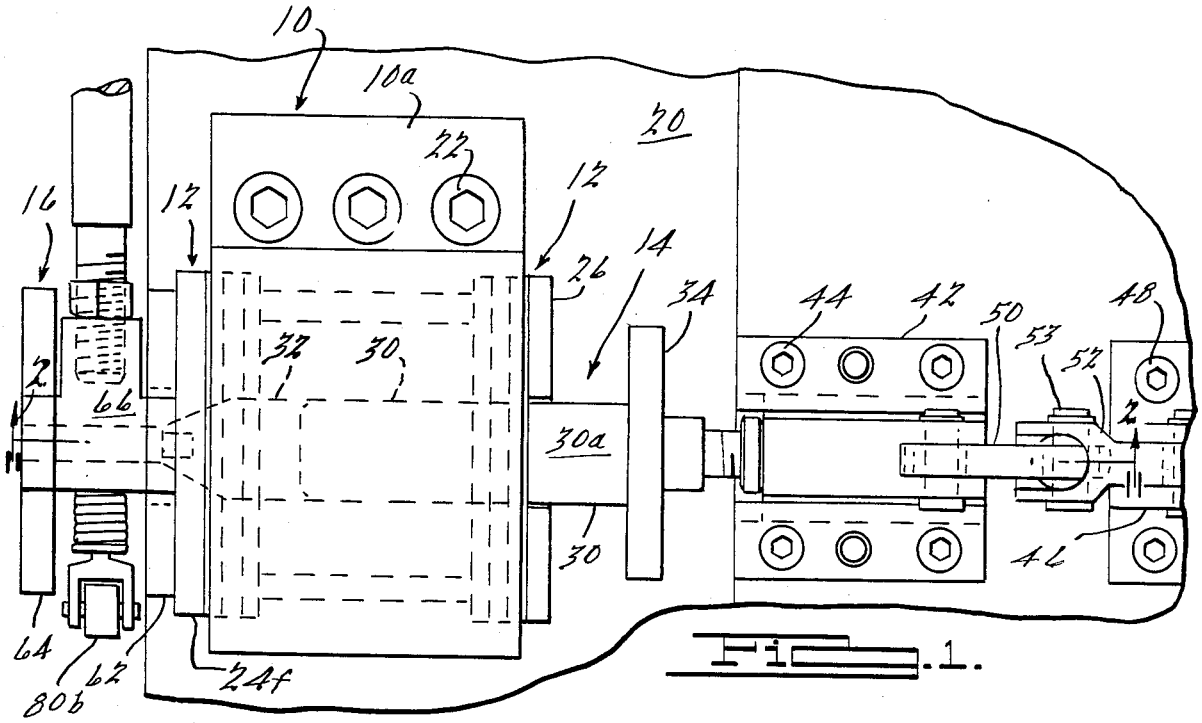
FIG. 1 is a plan view of the invention transfer mechanism.

The invention transfer mechanism, broadly considered, includes a pillow block 10, a pivot shaft assembly 12, a cam assembly 14, a cam assembly drive means 15, a rocker arm assembly 16, and a jaw assembly 18.

Pillow block 10 is positioned on a die block 20 and includes a flange portion 10*a* receiving bolts 22, by which the pillow block is secured to die block 20, and a main body portion 10*b* defining a central bore 10*c*.

Figure 6:
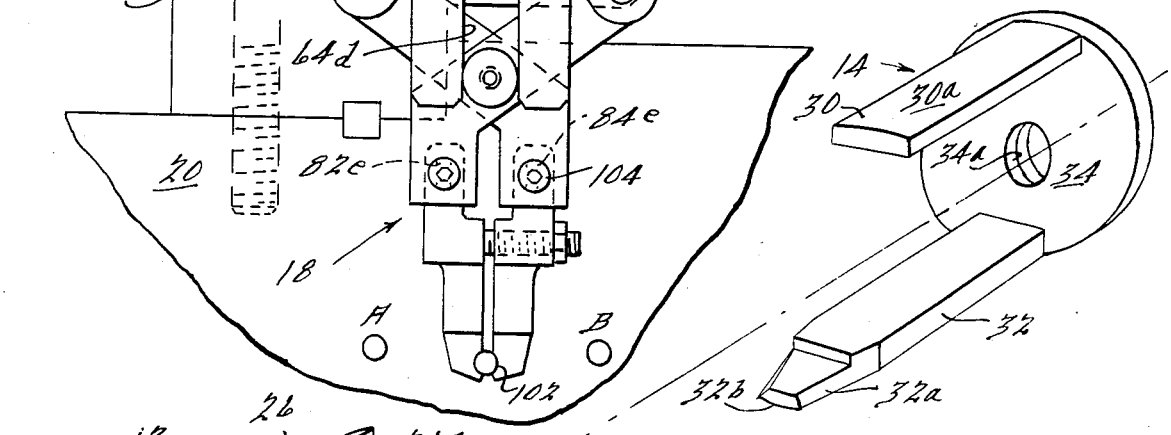
FIG. 6 is an exploded perspective view of the pivot shaft and cam assembly of the invention transfer mechanism.
Figure 6:
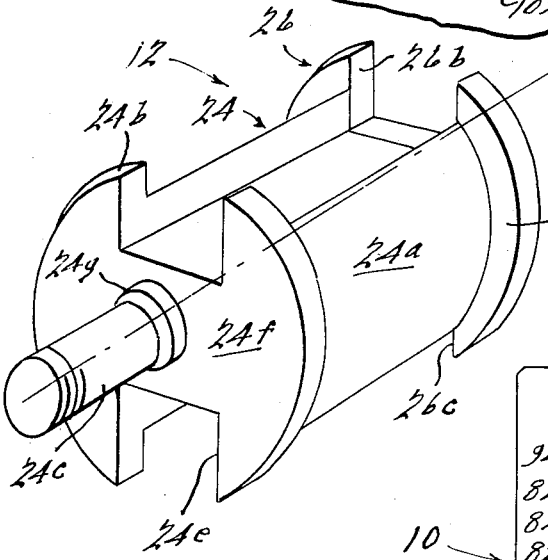

Pivot shaft assembly 12 is seen as a separate assembly in FIG. 6 and as a part of the overall transfer mechanism in the other figures. Pivot shaft assembly 12 includes a pivot shaft 24 and a retainer plate 26.

Pivot shaft 24 includes a main body cylindrical guide portion 24*a*, a flange portion 24*b*, and a shaft portion 24*c*. Guide portion 24*a* is journaled in bore 10*c* of pillow block 10 by bearing members 28. A pair of diametrically opposed upper and lower slideways 24*d*, 24*e* extend axially through guide portion 24*a* and flange portion 24*b*. Retainer plate 26 is circular and has a diameter greater than that of guide portion 24*a* so that, when plate 26 is bolted to the end of pivot shaft 24 remote from pivot shaft flange portion 24*b*, a flange portion 26*a* is defined. Pivot shaft 24 is precluded from axial movement in pillow block 10 by the coaction of pivot shaft flange portion 24*b* and retainer plate flange portion 26*a*. Retainer plate 26 is cut out at 26*b* and 26*c* to match slideways 24*d*, 24*e*.

Cam assembly 14 is seen as a separate assembly in FIG. 6 and as part of the overall transfer mechanism in the other figures. Cam assembly 14 includes an upper slide member 30, a lower slide member 32 having a cammed or wedged end 32*a*, and a bridge member 34.

Upper slide member 30 is slidably positioned in upper slideway 24*d* and lower slide member 32 is slidably positioned in lower slideway 24*e*. Slide members 30 and 32 have arcuate upper surfaces 30*a* and 32*b* centered on the axis of pivot shaft 24 so that the slide members complete the cylindrical exterior surface of guide portion 24*a*.

Bridge member 34 comprises a circular plate with a diameter equal to that of pivot shaft guide portion 24*a*. Slide members 30, 32 are secured by bolts 36 and pins 38 to upper and lower peripheral portions of bridge member 34.

Cam assembly drive means 15 includes a slide 40 mounted for sliding movement in a track member 42 secured by bolts 44 to die block 20; a pivot post 46 secured by bolts 48 to die block 20; and a pair of drive links 50, 52 pivoted at their one ends on a pivot pin 53 and pivotally connected at their other ends to slide 40 and post 46, respectively. A bolt 54 is threaded into a tapered bore 40*a* in slide 40 and locked in a position of adjustment by a nut 56. The head 54*a* of bolt 54 is tapped at 54*c* to receive a screw bolt 56 passing through a washer 58 received in a central bore 34*a* of bridge member 34. Washer 58 and bolt head 54*a* clampingly coact with the inner race of a bearing 60 received in a counterbore 34*b* in bridge member 34.

Rocker arm assembly 16 includes a rear plate 62, a front plate 64, and a drive link 66.

Figure 5:
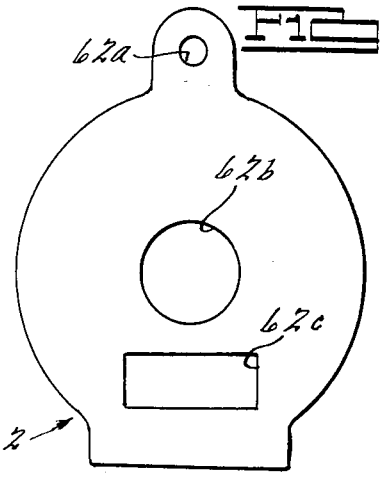
FIG. 5 is a detail view of one element of the invention transfer mechanism.

Rear plate 62, best seen in FIG. 5, is generally circular and includes a top hole 62*a*, a central bore 62*b*, and a generally rectangular window 62*c* positioned below central bore 62*b*. Plate 62 is bolted to the forward face 24*f* of pivot shaft 24 with central bore 62*b* receiving pivot shaft hub portion 24*g* and window 62 axially aligned with lower slideway 24*e* so as to pass the cam wedge end 32*a* of lower slide member 32.

Front plate 64 is elongated and includes a hole 64*a* in its upper end, a central bore 64*b*, a generally rectangular window 64*c* positioned below central bore 64*b*, and an elongated slot 64*d* opening at the lower end of plate 64. Plate 64 is positioned on pivot shaft 24 with central bore 64*b* passing shaft portion 24*c* and window 64*c* axially aligned with window 62*c* and lower slideway 24*e*. Bolts 68 pass through front plate 64 and through rear plate 62 for threaded engagement with tapped holes in the forward face 24*f* of pivot shaft 24 and a nut 70 engages the threaded end of shaft portion 24*c*.

Drive link 66 is positioned between the upper ends of plates 62, 64 and pivots on bushings carried by a pivot bolt 72. Bolt 72 passes through aligned holes 62*a*, 64*a* for engagement with a nut 73. The threaded end 74*a* of a drive link 74 is received in a tapped bore 66*a* in link 66 and a nut 76 locks link 74 in any position of adjustment relative to link 66.

Jaw assembly 18 is in the form of a scissors mechanism and includes a first pair of levers or links 78, 80; a second pair of levers or links 82, 84; and a pair of transfer fingers or jaws 86, 88.

Levers 78, 80 include central hub portions 78*a*, 80*a* journaled side by side on pivot shaft portion 24*c* between front and rear rocker arm assembly plates 62 and 64; upper portions 78*b*, 80*b*; and lower portions 78*c*, 80*c* angled with respect to upper portions 78*b*, 80*b* and terminating in clevis portions 78*d*, 80*d*. Each lower portion 78*c*, 80*c* is provided with a transverse slot 78*e*, 80 *e* and a pair of rollers 90,92 are journaled in the respective slots for coaction with the opposite cam surfaces of wedge end 32*a* of lower slide member 32.

Levers 82, 84 include upper portions 82*a*, 84*a*, respectively pivotally connected to clevis portions 78*d*, 80*d* of levers 78, 80 by pivot pins 94; central portions 82*b*, 84*b* pivotally mounted on a guide pin assembly 96; and lower portions 82*c*, 83*c* defining guideways 82*d*, 84*d*. Guide pin assembly 96 includes a pivot pin 98 passing through central portions 82*b*, 84*b* of levers 82, 84 and a bearing 100 journaled on the forward end of pin 98 and slidably and rollably guiding in slot 64*d* in front rocker arm assembly plate 64.

Transfer fingers or jaws 86, 88 are received at their upper ends in guideways 82*d*, 84*d* of levers 82, 84 and are configured at their lower ends to define coacting gripping portions 86*a*, 88*a* for grasping a work article such as a slug 102. Bolts 104 secure fingers 86, 88 in guideways 82*d*, 84*d* and coact with slots 82*e*, 84*e* to allow vertical adjustment of the fingers in the guideways. A bolt 106 passes threadably through righthand finger 88 and coacts with a locknut 108 to provide fine adjustment of the spacing between gripping portions 86*a*, 88*a*. A coil spring 110 tensioned between upper portions 78*b*, 80*b* of levers 78, 80 acts to bias gripping portions 86*a*, 88*a* toward their closed positions.

Figure 3:
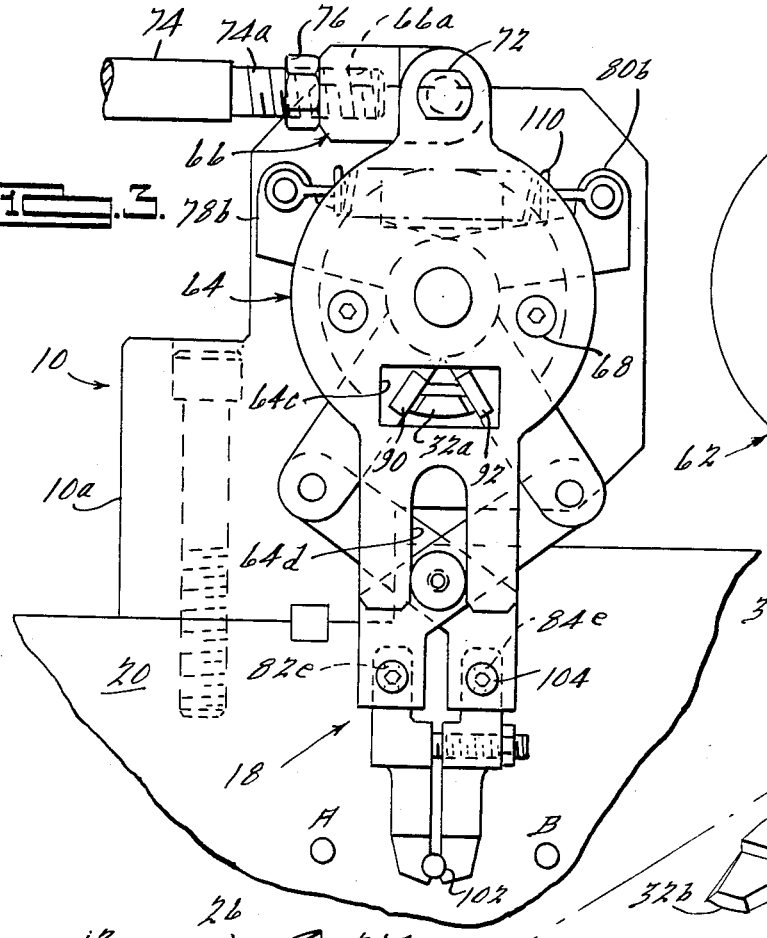
FIGS. 3 and 4 are end view of the invention transfer mechanism respectively showing the jaws in their closed and open positions.
Figure 4:
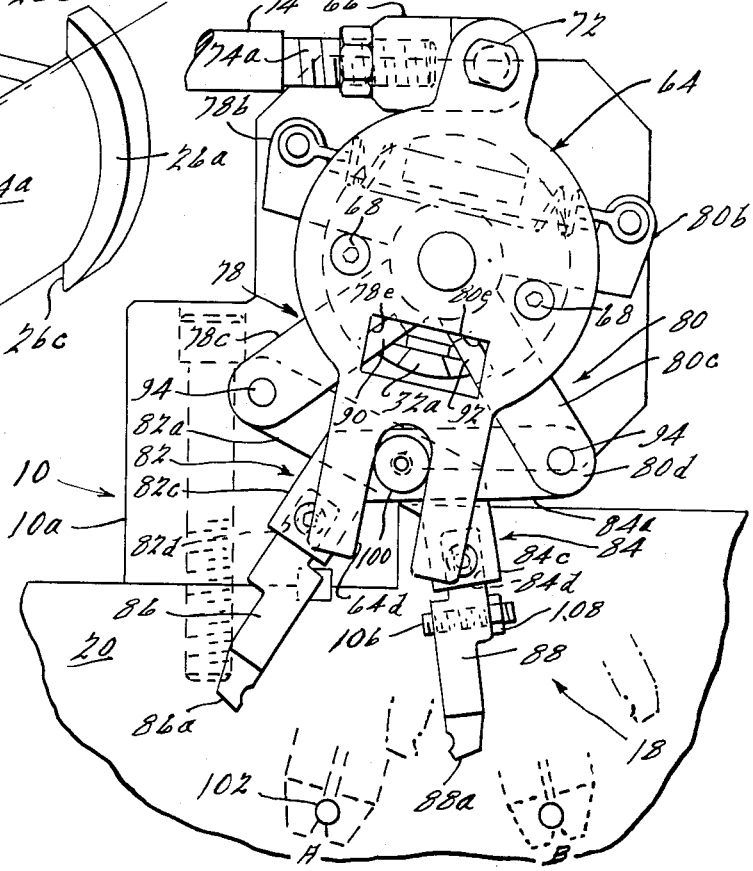

The invention transfer mechanism functions to transfer a workpiece, such as a slug 102, between work stations or dies, such as seen at A and B in FIGS. 3 and 4.

Figure 2:
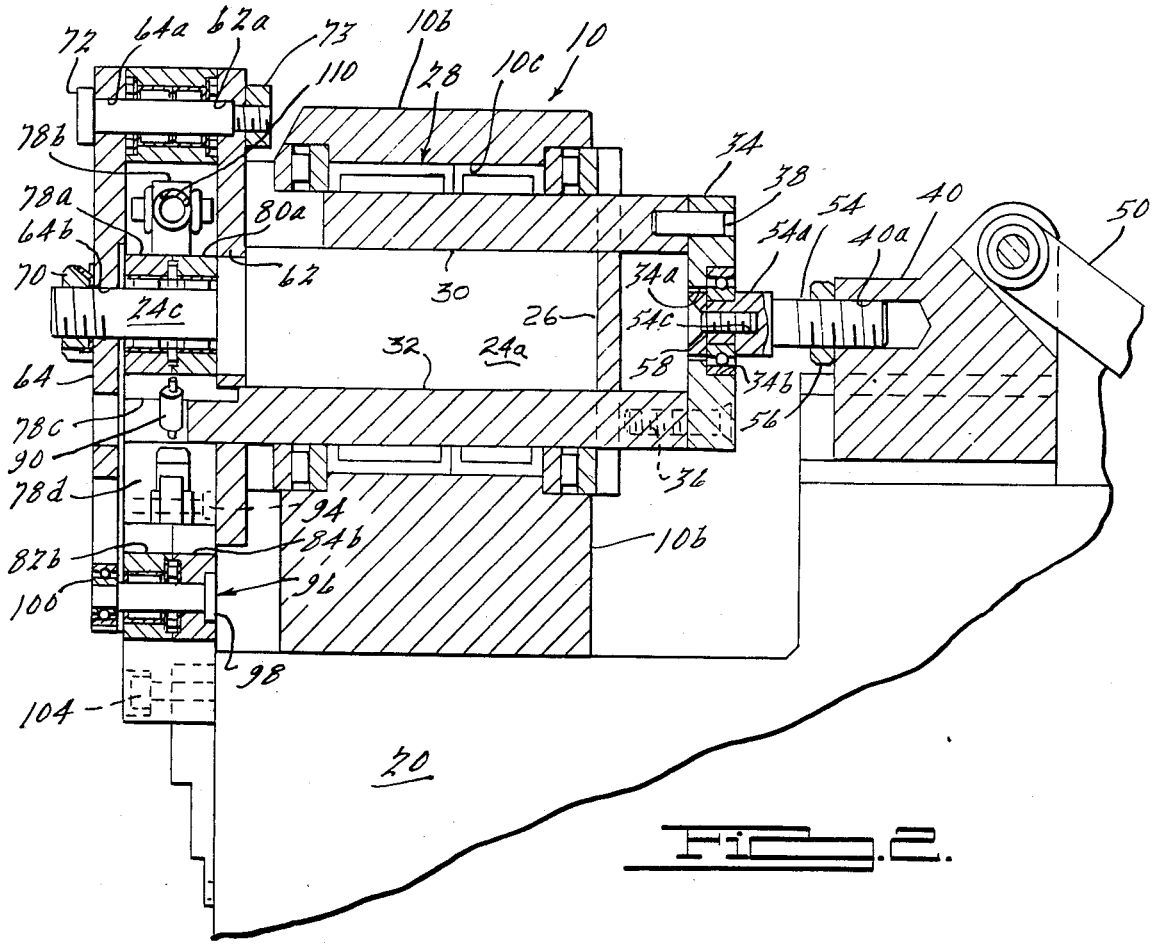
FIG. 2 is a cross-sectional view taken on line 2—2 of FIG. 1.

In a typical operational sequence, with the fingers or jaws 86, 88 positioned at die A, as seen in fragmentary dash lines in FIG. 4, a slug 102 is pushed into the fingers and held in place by the pressure of spring 110. Drive link 74 is now moved to the left, as seen in FIGS. 3 and 4, by a suitable cam drive mechanism (not shown) to pivot rocker arm assembly 16 counterclockwise about the axis of pivot shaft assembly 12 and move fingers 86, 88, together with the grasped slug, to die B. The fingers and grasped slug are seen in FIG. 3 at an intermediate point in their travel between the two dies and are seen in fragmentary dotted lines in FIG. 4 at the instant of arrival at die B. As the fingers and grasped slug arrive at die B, the ram of a heading machine (not shown) travels forward to bring a punch into engagement with the slug to push the slug into the die. As the punch moves forwardly, cam assembly drive linkage 50, 52 is suitably cam actuated to raise pivot pin 53, move slide 40 to the left as viewed in FIGS. 1 and 2, and wedgingly insert cam end 32*a* of cam assembly slide member 32 between rollers 90, 92. As cam end 32*a* moves between rollers 90, 92, lever portions 78*c*, 80*c* are progressively splayed. As lever portions 78*c*, 80*c* splay, the scissors action of the jaw assembly causes bearing 100 to ride upwardly in slot 64*d* and causes jaws 86*a*, 88*a* to open and to simultaneously move upwardly. The final open and raised position of the jaws is seen in fragmentary chain lines in FIG. 4. The simultaneous opening and raising movement thus imparted to the jaws enables the jaws to crisply and positively clear the incoming punch. Drive link 74 is now moved to the right by the cam drive mechanism to pivot rocker arm assembly 16 clockwise about the axis of pivot shaft assembly 12 and move the fingers, still in their open and raised position, back to die A. Just prior to arriving at die A, the cam drive mechanism controlling the fingers is actuated in a sense to withdraw slide wedge end 32*a* from between rollers 90, 92 and allow the fingers to move, under the urging of coil spring 110, from their open and raised position, as seen in solid lines in FIG. 4, to their lowered and closed position, as seen in fragmentary dash lines in FIG. 4. The fingers are now again positioned at die A ready to receive a slug 102 for subsequent transfer to die B.

The invention transfer mechanism will be seen to provide a single mechanism for effecting both the translatory movement of the jaws from station to station and the opening and closing movement of the jaws at either station. The invention transfer mechanism thus eliminates considerable reciprocating mass as compared to prior art mechanisms, thereby allowing substantially higher operational speeds. And the invention transfer mechanisms allows independent adjustment of the opening and closing action of the jaws and of the translatory movement of the jaws. Specifically, the manner and degree of translatory movement of the jaws may be precisely adjusted by the varying the cam profile of the rocker arm drive mechanism and/or by varying the position of threaded adjustment of link 74 in link 66, and these adjustments will not effect the adjustment of the opening and closing movement of the jaws. And, conversely, the manner and degree of opening and closing movement of the jaws can be precisely adjusted by varying the cam profile of the cam assembly drive mechanism and/or by varying the position of threaded adjustment of bolt 54 in slide 40, and these adjustments will not effect the adjustment of the translatory movement of the jaws.

While a preferred embodiment of the invention has been illustrated and described in detail, it will be apparent that various changes may be made in the disclosed embodiment without departing from the scope or spirit of the invention.

I claim:

1. A transfer mechanism comprising:

(A) a support structure;

(B) a pivot shaft journaled in said support structure for rotary movement about its longitudinal axis;

(C) a jaw assembly comprising a scissor mechanism mounted for rotary movement with said pivot shaft and including a pair of jaws disposed remote from said axis, a first pair of levers pivoted on said pivot shaft, and a second pair of levers each pivoted at its one end to one end of a respective one of said first pair of levers, pivoted intermediate their ends to a common guide pin, and respectively forming said pair of jaws at their free ends;

(D) pivot shaft drive means operative to selectively rock said pivot shaft about said axis and thereby selectively move said jaws between spaced work stations;

(E) a cam assembly mounted on said pivot shaft for rotary movement with said shaft and axial movement along said shaft, including a cam slide member positioned to move wedgingly between said first pair of levers at a location adjacent said axis in response to axial movement of the cam assembly along said pivot shaft, whereby to splay said first pair of levers and thereby collapse said scissors mechanism to open said jaws and move them toward said axis as said guide pin moves in said slot toward said axis;

(F) cam assembly drive means operative to selectively move said cam assembly axially along said pivot shaft;

(G) means operative in response to axial movement of said cam assembly along said pivot shaft to selectively open and close said jaws in any angular position of said pivot shaft; and (H) means mounted for rotary movement with said pivot shaft and defining a guide slot extending generally normal to said axis and slidably receiving a portion of said guide pin.

2. A transfer mechanism comprising:

(A) a support structure;

(B) a pivot shaft journaled in said support structure for rotary movement about its longitudinal axis;

(C) a jaw assembly mounted for rotary movement with said pivot shaft and including a pair of jaws disposed remote from said axis;

(D) pivot shaft drive means operative to selectively rock said pivot shaft about said axis and thereby selectively move said jaws between spaced work stations;

(E) a cam assembly mounted on said pivot shaft for rotary movement with said shaft and axial movement along said shaft;

(F) cam assembly drive means operative to selectively move said cam assembly axially along said pivot shaft;

(G) means operative in response to axial movement of said cam assembly along said pivot shaft to selectively open and close said jaws in any angular position of said pivot shaft;

(H) said pivot shaft defining generally diametrically opposed, generally coextensive axial slideways; and (I) said cam assembly includes:

(1) a first slide member in one of said slideways having a wedged end for camming coaction with said jaw assembly;

(2) a second slide member in the other slideway; and (3) a bridge member rigidly interconnecting the ends of said slide members remote from said wedged end and drivingly engaging said cam drive means.

3. A transfer mechanism according to claim 2 wherein:

(J) said cam drive means includes:

(1) a slide block member mounted on said support structure for reciprocal movement in a direction parallel to said axis; and (2) means journaling said bridge member on said slide block member for rotation about said axis, whereby said cam assembly may rotate with said pivot shaft in response to actuation of said pivot shaft drive means and may slide along said pivot shaft in response to actuation of said cam drive means.

4. A transfer mechanism comprising:

(A) a support structure;

(B) a pivot shaft journaled in said support structure for rotation about its central longitudinal axis;

(C) a rocker arm rigidly secured to said pivot shaft and extending generally normal to said axis;

(D) a jaw assembly mounted for rotary movement with said arm and including a pair of jaws disposed adjacent one end of said arm;

(E) a cam assembly mounted on said pivot shaft for rotary movement with said pivot shaft and axial movement along said pivot shaft;

(F) reciprocal rocker arm drive means engaging said arm at a location remote from said axis and remote from said one end and operative when actuated to rock said arm about said axis and selectively move said jaws between spaced work stations;

(G) reciprocal cam assembly drive means engaging said cam assembly and operative when actuated to move said cam assembly axially along said pivot shaft;

(H) means operative in response to axial movement of said cam assembly along said pivot shaft to selectively open and close said jaws;

(I) said rocker arm includes a guide slot adjacent said one end thereof;

(J) said jaw assembly includes:

(1) a first pair of levers pivoted on said pivot shaft;

(2) a second pair of levers pivoted at their one ends to one end of a respective one of said first pair of levers, pivoted immediate their ends to a guide pin assembly, and respectively defining said pair of jaws at their free ends;

(K) said guide pin assembly includes a guide portion positioned in said guide slot for movement along the length of said slot; and (L) said cam assembly includes a slide member having a wedged end and having a line of action extending between said first pair of levers adjacent said axis so that as said cam assembly moves axially on said pivot shaft, said wedged end of said slide member is inserted between said first pair of levers to splay these levers and cause said guide portion of said guide pin assembly to move in said guide slot toward said axis and cause said jaws to open and move toward said axis.

5. A transfer mechanism according to claim 4 wherein:

(M) each lever of said first pair is pivoted intermediate its ends on said pivot shaft and (N) spring means are tensioned between the free ends of said first pair of levers to bias said jaws toward a closed position.

6. A transfer mechanism comprising:

(A) a rocker arm mounted for rotary movement about a fixed pivot axis and having a guide slot in an end portion of the arm remote from said pivot axis;

(B) a guide pin assembly including a guide portion positioned in said slot for movement along the length of said slot;

(C) a scissors mechanism comprising:

(1) a first pair of levers each pivoted on said fixed pivot axis and (2) a second pair of levers pivoted at their one ends to one end of a respective one of said first pair of levers, pivotally mounted intermediate their ends on a shaft portion of said guide pin assembly, and respectively defining a pair of opposed jaws at their free ends;

(D) means for rocking said arm about said fixed pivot axis, whereby to selectively move said jaws between spaced work stations; and (E) cam means mounted for movement with said rocker arm and positioned for camming insertion between said first pair of levers adjacent said pivot axis, whereby to selectively spread and close said second pair of levers and selectively open and close said jaws as said guide portion of said guide pin assembly slides in said slot.

7. A transfer mechanism according to claim 6 wherein:

(F) said mechanism further includes a pivot shaft mounted on said pixot axis;

(G) said arm is rigidly secured to a first portion of said pivot shaft;

(H) said first pair of levers are journaled on a second portion of said pivot shaft;

(I) said cam means includes a slide member mounted for rotation with a third portion of said pivot shaft;

(J) said third pivot shaft portion includes means mounting said slide member for axial sliding movement relative to said third pivot shaft portion; and (K) said slide member has a wedging cam profile at one end projecting between said first pair of levers adjacent said pivot shaft, whereby said slide member rotates with said pivot shaft as said arm is rocked to maintain the cam end of said slide member in a position to actuate said jaws in any angular position of said rocker arm.

8. A transfer mechanism according to claim 7 wherein:

(L) said transfer mechanism further includes drive means for selectively moving said slide member axially along said third pivot shaft portion to selectively wedge said cam end between said first pair of levers.

9. A transfer mechanism according to claim 8 wherein:

(M) said first and third pivot shaft portions are respectively adjacent the opposite ends of said pivot shaft and said second portion is between said first and third portions.

10. A transfer mechanism according to claim 8 wherein:

(N) said drive means includes a drive member mounted for reciprocal movement in a direction generally parallel to the axis of said pivot shaft and drivingly connected to said slide member in a manner to allow rotation of the slide member relative to the drive member, whereby to allow the slide member to rotate with the pivot shaft and arm while maintaining the driving connection between the slide member and the drive member to allow actuation of the jaws in any angular position of the arm.

11. A transfer mechanism according to claim 10 wherein:

(O) said third pivot shaft portion defines diametrically opposed axially extending slideways;

(P) said slide member is slidably mounted in one of said slideways;

(Q) said cam means further includes another slide member slidably mounted in the other of said slideways and a bridging member rigidly interconnecting the ends of said slide members remote from said wedged end; and (R) said drive member is connected to said bridging member in a manner to allow the bridging member and slide members to rotate relative to the drive member.

12. A transfer mechanism according to claim 11 wherein:

(S) said bridging member is mounted on said drive member for rotation about said axis and (T) said slide members are connected to diametrically opposed locations adjacent the periphery of said briding member.

* * * * *